US006845823B2

(12) United States Patent
Shiga

(10) Patent No.: US 6,845,823 B2
(45) Date of Patent: Jan. 25, 2005

(54) FLUOROSURFACTANT-FREE FOAM FIRE-EXTINGUISHER

(75) Inventor: Hiroshi Shiga, Chigasaki (JP)

(73) Assignee: GTL Co., Ltd., Kanagawa (JP)

( * ) Notice: Subject to any disclaimer, the term of this patent is extended or adjusted under 35 U.S.C. 154(b) by 0 days.

(21) Appl. No.: 10/470,743

(22) PCT Filed: Nov. 21, 2002

(86) PCT No.: PCT/JP02/12213

§ 371 (c)(1),
(2), (4) Date: Aug. 11, 2003

(87) PCT Pub. No.: WO03/043526

PCT Pub. Date: May 30, 2003

(65) Prior Publication Data

US 2004/0074650 A1 Apr. 22, 2004

(30) Foreign Application Priority Data

Nov. 22, 2001 (JP) ..... 2001-358428

(51) Int. Cl.[7] ..... A62C 2/00

(52) U.S. Cl. ..... 169/46; 252/3; 252/8; 252/8.05

(58) Field of Search ..... 169/46, 47; 252/3, 252/8, 8.05

(56) References Cited

FOREIGN PATENT DOCUMENTS

| | | |
|---|---|---|
| EP | 0 206 548 | 12/1986 |
| EP | 0 659 472 | 6/1995 |
| EP | 0 958 804 | 11/1999 |
| EP | 1 154 324 | 11/2001 |
| JP | 48-19037 | 6/1973 |
| JP | 51-84197 | 7/1976 |
| JP | 52-34158 | 9/1977 |
| JP | 59-181173 | 10/1984 |
| JP | 60-41977 | 3/1985 |
| JP | 61-185325 | 8/1986 |
| JP | 1-12502 | 3/1989 |
| JP | 3-63386 | 9/1991 |
| JP | 7-38884 | 5/1995 |
| JP | 7-303826 | 11/1995 |
| JP | 2000-126327 | 5/2000 |
| JP | 2001-11491 | 1/2001 |
| JP | 2001-131132 | 5/2001 |
| JP | 2001-246012 | 9/2001 |

*Primary Examiner*—Gene Mancene
*Assistant Examiner*—Thach H. Bui
(74) *Attorney, Agent, or Firm*—Westerman, Hattori, Daniels & Adrian, LLP

(57) ABSTRACT

The present invention provides a foam fire-extinguishing agent devoid of environmentally harmful fluorochemical surfactant. The foam fire-extinguishing agent comprises a foamable synthetic surfactant consisting of (a) polyoxyethylene alkyl sulfate ester salt, and (b) at least either one of lauric acid amide propyldimethyl amino betaine acetate and lauric acid amide propylhydroxy sulfobetaine. This foam fire-extinguishing agent may further include at least either one of (c) polyoxyalkylenediamine having both terminal ends substituted with amino alkyl, and derivatives thereof, (d) polyoxyethylene coconut fatty acid monoethanol amide phosphate ester and (e) dodecyl alcohol. The foam fire-extinguishing agent is usable as both high- and low-expansion foam fire-extinguishing agents and in both seawater-diluted and freshwater-diluted forms while maintaining excellent performances such as water-retentivity within foams, durability to heat, liquid resistance allowing foams to stay on a burning liquid surface over an extended time-period, and flowability capable of covering over the burning liquid surface in a short time-period.

7 Claims, No Drawings

FLUOROSURFACTANT-FREE FOAM FIRE-EXTINGUISHER

FIELD OF THE INVENTION

The present invention relates to a novel fire-extinguishing agent devoid of fluorochemical surfactant, and more particularly to a synthetic-surfactant-based foam fire-extinguishing agent capable of providing enhanced heat resistance of foams to flame and improved water-retentivity within foams. The fire-extinguishing agent of the present invention is usable in either high- or low-expansion foam fire-extinguishing agent and in either diluted form with seawater or freshwater, with an excellent fire-extinguishing performance.

BACKGROUND OF THE INVENTION

In late years, development in chemical industries leads to enormously increased production and consumption of not only water-insoluble flammable liquids, such as gasoline and naphtha, but also water-soluble flammable liquids, such as alcohol ether and ester, and their stored amount and associated storage facilities have been increasingly scaled up. This circumstance involves an increasing risk of disasters such as fires, and countermeasures against such disasters become more difficult.

Heretofore, an aqueous-film-forming foam fire-extinguishing agent, typically a fire-extinguishing agent using fluorochemical surfactant excellent in preventing re-ignition of oil fire, has been used as a fire-extinguishing agent for large-scale oil fires in oil storage bases or the like. The fluorochemical surfactant must, however, be used in a high concentration to maintain adequate resistance to flame or durability to heat.

For this reason, there have been developed various modified aqueous-film-forming foam fire-extinguishing agents prepared, for example, by adding hydrocarbon-based surfactant to fluorochemical surfactant to provide reduced boundary tension between oil and water and enhanced aqueous-film-forming performance while reducing the enquired amount of fluorochemical surfactant, or by using low-molecular-mass amine compounds and fluorine-contained betaine-based surfactant (foaming agent) as base materials (Patent Publication No. 1)

There has also been developed a foam fire-extinguishing agent comprising polyethyleneglycol, which has a molecular mass of greater than 3000 and both terminal ends substituted with amino alkyl, its derivatives, and a foaming agent, as base materials (Patent Publication No. 2). It is described that this foam fire-extinguishing agent had an expansion ratio of about 6 to 8:1 and a fire-extinguishing time of 10 to 15 minutes in a fire-extinguishing test for a compact fire-extinguisher using the agent, and the foaming agent may be any conventional surface-active compound for fire-extinguishing agents, such as a hydrocarbon-based surface-active compound or a fluorochemical surface-active compound, preferably, a fluorochemical surface-active compound.

There has been known another foam fire-extinguishing agent prepared by mixing foamable surfactants such as fluorochemical surfactant and poly (oxyalkylene) polyisocyanate polymer in which the oxyalkylene chains contain sufficient oxyethylene-units to provide hydrophilic and water-solubility in the polymer (Patent Publication No. 3).

There has been known still another aqueous-film-forming foam fire-extinguishing agent essentially comprising (A) polyallylamine, (B) copolymer of dimethyldiallyl ammonium salt and maleic acid, and (C) perfluoroalkyl group-contained nonionic surfactant (Patent Publication No. 4).

There has been known yet another foam fire-extinguishing agent prepared by mixing alginic acid and its derivatives, natural or synthetic polymer compound, foamable surfactant, and fluorochemical surfactant (Patent Publication No. 5).

There has been known another further foam fire-extinguishing agent comprising hydrolyzed protein and fluorochemical surfactant added thereto. While this agent is usable for both oil and alcohol fires, it has poor storage performance due to formation of deposits readily caused by change in pH, and cannot be effectively used for extinguishing fires of acidic water-soluble flammable substance such as acetic acid.

There has been known a synthetic-surfactant-based foam fire-extinguishing agent devoid of fluorochemical surfactant, prepared by adding a higher alcohol serving as a foaming accelerator to hydrocarbon-based surfactant, such as a higher alcohol sulfate ester salt having a carbon number of 12 to 18, preferably lauryl alcohol ammonium sulfate ester or lauryl alcohol sulfuric ester triethanolamine salt, or a polyoxyethylene alkyl sulfate ester salt, and optionally mixing a foaming stabilizer, a freezing point depressant and/or a rust-inhibitor (Patent Publication Nos. 6 and 7).

Patent Publication No. 1) Japanese Patent Publication No. H01-12502

Patent Publication No. 2) Japanese Patent Publication No. H03-63386

Patent Publication No. 3) Japanese Patent Publication No. H07-38884

Patent Publication No. 4) Japanese Patent Laid-Open Publication No. 2000-126327

Patent Publication No. 5) Japanese Patent Laid-Open Publication No. 2001-246012

Patent Publication No. 6) Japanese Patent Publication No. S48-19037

Patent Publication No. 7) Japanese Patent Publication No. S52-34158

While the synthetic-surfactant-based foam fire-extinguishing agent has been developed as a high-expansion foam fire-extinguishing agent for fires in specific enclosed spaces, such as rack warehouses for hazardous substances, tunnels or mine cavities, underground shopping areas, underground parking lots or high-rise buildings, its water retentivity is lowered as the expansion ratio is increased, resulting in deteriorated fire-extinguishing performance.

As described above, most of the conventional aqueous-film-forming foam fire-extinguishing agents have been prepared by adding fluorochemical surfactant. However, perfluorooctanyl compounds constituting the fluorochemical surfactant involve a risk of causing environmental disruption as with chlorofluorocarbons and halons, because they can actually spread over environments and stay there for ages, and the productions of the fire-extinguishing agents using fluorine-based compounds have been consistently discontinued in accordance with an Environmental Protection Agency's policy issued on October 2000 of applying a Significant New Use Regulation to "$C_8F_{12}SO_3$. . . chlorides".

Under the above situation, the aqueous-film-forming foam fire-extinguishing agents have been suffered from difficulty in fulfilling the requirement of 3.5 or more diffusion coefficient in accordance with Japan ministerial decree (Home Affairs Ministry's Decree No. 26) prescribing the standards of aqueous-film-forming foam fire-extinguishing agents, without using any fluorochemical surfactant which has provided a surface tension action for forming aqueous films. As above, there is a strong need for developing a new foam fire-extinguishing agent usable in oil industrial complexes, large-scale plants, military facilities, airports or ships/vessels and in either diluted form with seawater or freshwater, as a substitute for foam fire-extinguishing agents using fluorochemical surfactant.

SUMMARY OF THE INVENTION

In view of the above problems, it is therefore an object of the present invention to provide a synthetic-surfactant-based foam fire-extinguishing agent capable of providing enhanced foamability, expandability, vaper-sealability, water-retentivity and durablity to heat resistance as compared to protein foam fire-extinguishing agents, and usable in either high- or low-expansion foam fire-extinguishing agent applicable to both water-insoluble flammable substances such as gasoline and water-soluble flammable substances such as alcohol and in either diluted form with seawater or freshwater, with an excellent fire-extinguishing performance superior to that of Lightwater (trademark of 3M, USA) which was a representative aqueous-film-forming foam fire-extinguishing agent using fluorochemical surfactant.

In order to achieve the above object, the present invention provides a newly developed synthetic-surfactant-based foam fire-extinguishing agent devoid of fluorochemical surfactant capable of achieving an excellent performance equivalent to that of conventional aqueous-film-forming foam fire-extinguishing agents using fluorochemical surfactant. More specifically, the present invention provides a sophisticated high-expansion foam fire-extinguishing agent having an expansion ratio of about 500 to 1000:1 which has not been practicable. In a low-expansion foam fire-extinguishing agent typically for oil fires having an expansion ratio of about 5 to 10:1, the present invention also provides a practical performance equivalent to that of aqueous-film-forming foam fire-extinguishing agents, such as a durability to heat or resistance to flame capable of remaining on a burning liquid surface over an extended time-period and an excellent flowability capable of covering over the burning liquid surface in a short time-period.

Generally, the foamability of surfactant is influenced a great deal by the type or added amount of the surfactant. It is know that a combination of several surfactants different in type provides a higher foamability than that obtained from a single surfactant, and a combination of surfactants different in ionicity, for example, of anionic and nonionic surfactants or anionic and zwitterionic surfactants, can provide high-quality foams. For example, Japanese Patent Publication No. H03-66933 discloses a foaming auxiliary agent having significantly enhanced foamability and foam-stability in aqueous foams obtained by combining surfactants in the above manner, and a fire-extinguishing chemical containing the foaming auxiliary agent.

The inventor made researches on various combinations of surfactants having an adequate performance substitutive for fluorochemical surfactant. As a result, the inventor found that a specific combination of surfactants could provide an adequate performance substitutive for fluorochemical surfactant. The inventor also found that when this specific combination of surfactants was used with polyoxyalkylenediamine, which is a water-soluble macromolecule having both terminal ends substituted with amino alkyl, and its derivatives, or polyoxyethylene coconut fatty acid monoethanol amide ester salt, or higher alcohol such as dodecyl alcohol, excellent performances of foams superior to a fluorochemical surfactant-based foam could be obtained in expandability, sealability, foamability and water-retentivity, for unknown reasons.

A surfactant-based foam fire-extinguishing agent should be prepared on the assumption that it will be diluted with not only freshwater (plain water) but also seawater. Thus, it is necessary to provide a measure for eliminating ions which cause functional deteriorations in seawater, so as to maintain an even performance of surfactant in both freshwater and seawater.

A specific surfactant, such as polyoxyethylene alkyl sulfate ester salt, lauryl sulfate salt, polyoxyethylene alkylether triethanolamine, alky carboxybetaine or N, N-dimethylalkyamine oxide, exhibits excellent performances of foamability, flowability and foam-stability even in seawater.

Each of polyoxyethylene alkyl sulfate ester salt and lauryl sulfate salt exhibits excellent foamability and relatively high foam-stability individually even in their diluted form with seawater. However, in a fire-extinguishing test using a seawater-diluted mixture of polyoxyethylene alkyl sulfate ester salt and lauryl sulfate salt, while an adequate foamability was obtained in an initial discharging stage, foams became smaller in time, and then the foam blanket gradually going under or became thinner, which led to re-ignition. This phenomenon would be caused by a chemical action of calcium and magnesium contained in seawater.

The inventor found that this phenomenon could be effectively settled by adding nitrilotriacetic acid. It is believed that nitrilotriacetic acid acts on metal ions in seawater to block the activity of the metal ions while converting them into a water-soluble metal complex, and serves as a water-soluble ion-exchange agent for softening hard water to provide enhanced foamability. The water softened by nitrilotriacetic acid will be never changed unless pH becomes acidic. When a fire-extinguishing agent added with nitrilotriacetic acid is injected onto a metal surface, an oxide film to be created on the metal surface will have corrosion-resistant (anti-corrosion performance).

A foam fire-extinguishing agent containing in combination the synthetic surfactants of the present invention allows foams to be created with a significantly reduced time-based volume-reduction ratio and an enhanced durability to heat resistance, to provide adequate characteristics, such as foamability, equivalent to those of the conventional fluorochemical surfactant. While synthetic surfactant cannot reduce surface tension at the same level of that of fluorochemical surfactant, it provides fine and persistent foams capable of achieving an excellent fire-extinguishing performance superior to that of fluorochemical surfactant. Thus, differently from the conventional foam fire-extinguishing agents essentially using one surfactant selected from fluorochemical surfactants, the synthetic-surfactant-based foam fire-extinguishing agent of the present invention can provide an improved flowability without using any fluorochemical surfactants to achieve a rapid fire control of water-insoluble flammable substance fires such as oil fire or gasoline fire.

Specifically, the present invention provides a foam fire-extinguishing agent for use as a high-expansion or low-expansion foam fire-extinguishing agent. The foam fire-extinguishing agent comprises a foamable synthetic surfactant consisting of (a) polyoxyethylene alkyl sulfate ester salt, and (b) at least either one of lauric acid amide propyldimethyl amino betaine acetate and lauric acid amide propylhydroxy sulfobetaine. This foam fire-extinguishing agent is devoid of fluorochemical surfactant.

In one embodiment of the present invention, the foam fire-extinguishing agent may further include at least either one of (c) polyoxyalkylenediamine having both terminal ends substituted with amino alkyl, and derivatives thereof, (d) polyoxyethylene coconut fatty acid monoethanol amide phosphate ester, (e) dodecyl alcohol, (f) polyethyleneglycol, (g) lauryl sulfate salt, and (h) nitrilotriacetic acid.

The foam fire-extinguishing agent of the present invention could achieve an excellent performance in a fire-extinguishing test prescribed in Japanese Fire Defense Law. The foam fire-extinguishing agent of the present invention has the following advantages.

(1) Foams obtained from the foam fire-extinguishing agent contain a large volume of water content. Thus, the foam fire-extinguishing agent provides a reduced fire-extinguishing time-period, and an excellent performance of preventing re-ignition.
(2) Foams obtained from the foam fire-extinguishing agent have excellent flowability. Thus, even in a spilled-oil fire, the foam fire-extinguishing agent can extinguish the fire at a speed about two times faster than that in protein foam fire-extinguishing agent.
(3) The foam fire-extinguishing agent can be used at a dilution rate of 2 to 3 wt %.
(4) The foam fire-extinguishing agent can be selectively arranged in the wide range of a high expansion ratio to a low-expansion ratio.
(5) The foam fire-extinguishing agent is stable in quality to provide excellent storage performance.
(6) The foam fire-extinguishing agent can be used in either diluted form with seawater or freshwater.

The conventional synthetic-surfactant-based foam fire-extinguishing agent is generally diluted with water at a dilution rate of about 3 to 6 wt % before use. In the present invention, even if the rich concentrate solution of the foam fire-extinguishing agent of the present invention is diluted with freshwater or seawater at a dilution rate at 2 to 3 wt %, the diluted foam fire-extinguishing agent can provide an adequate fire-extinguishing performance. Thus, the foam fire-extinguishing agent of the present invention can achieve enhanced economical efficiency while saving a storage space.

The foam fire-extinguishing agent of the present invention has an adequate performance fulfilling both standers of US National Fire Protection Association (NFPA-11A) and Japanese Fire Defense Law (Rule 18) which prescribes that a medium-expansion foam having an expansion ratio of 200 to 300:1 is required for fire prevention equipments in chemical plant and closed spaces such as underground shopping areas, warehouses or ship's hold is, and a high-expansion foam having an expansion ratio of 500 or more: 1 is required for a stationary fire prevention equipment in parking lots or the like.

The foam fire-extinguishing agent of the present invention can be used for fire fighting in the usual manner. For example, the dilution rate of the foam fire-extinguishing agent is adjusted at 2 to 3 wt % by sucking its rich concentrate solution into water flow in the mid-flow as it is supplied to a fire-distinguishing device or a foam nozzle. Then, nonflammable gas such as air is injected into or mixed with the diluted foam fire-extinguishing agent to create foams, and the foams are discharged or supplied from an injection nozzle to a fire surface. In this operation, two types of injection nozzles can be selectively replaced to use the foam fire-extinguishing agent as either one of high-expansion and low-expansion foam fire-extinguishing agents. Particularly, when the foam fire-extinguishing agent is diluted with seawater, and used as low-expansion foam fire-extinguishing agent for an industrial complex or marine vessel fire, it can provide an equivalent performance to that of the conventional aqueous-film-forming foam fire-extinguishing agent. It is understood that the foam fire-extinguishing agent may be diluted in an adequate concentration in advance to use in a portable fire extinguisher.

In order to suppress the phenomenon in large-scale oil fires, such as weakened foam seal against a high-temperature surface, potential oil-surface exposure, deterioration in foam expandability and/or adhesiveness in a burning wall surface, the foam fire-extinguishing agent may be dispersed while discharging water to the wall surface or burning surface in large-scale oil fires to obtain enhanced performance by virtue of a cooling effect from the water.

DESCRIPTION OF THE PREFERRED EMBODIMENT

When polyoxyethylene alkyl sulfate ester salt [the above component (a)] is used in combination with lauric acid amide propyldimethyl amino betaine acetate or lauric acid amide propylhydroxy sulfobetaine [the above component (b)], the polyoxyethylene alkyl sulfate ester salt, one of anion surfactants, provides an enhanced foam-stability for holding high water-content foams, and a significantly enhanced foam-blanket-expandability for suppressing flame. The lauric acid amide propyldimethyl amino betaine acetate or lauric acid amide propylhydroxy sulfobetaine, one of zwitterionic surfactants in this agent, effectively acts as a water-retentivity improver, foamability improver, expandability improver and spreadability improver.

Preferably, the polyoxyethylene alkyl sulfate ester salt is prepared as a mixture in advance by mixing with a solvent containing diethyleneglycolmonobutylether, ethyleneglycol, dodecyl alcohol and water. The polyoxyethylene alkyl sulfate ester salt used in the form of such a pre-stirred/mixed mixture provides enhanced foam-stability, foamability and water-retentivity. Preferably, the polyoxyethylene alkyl sulfate ester salt is used as polyoxyethylene alkylether sulfate triethanolamine dissolved in triethanol.

Polyoxyalkylenediamine [the above component (c)] having both terminal ends substituted with amino alkyl acts to increase the viscosity of foams and create viscous foams. The viscous foams are firmly hold water to provide significantly enhanced water-retentivity of the foams, heat resistance of the foam fire-extinguishing agent, and liquid resistance allowing the foams to stay on a burning liquid surface over an extended time-period. The polyoxyalkylenediamine includes polyoxyethylenediamine, polyoxypropylenediamine, and polyoxyethylenepropylenediamine. The polyoxyalkylenediamine having both terminal ends substituted with amino alkyl is a known substance, and its typical example is polyethyleneglycol and its derivatives having a molecular mass in the range of greater than 3000 to 25000 as disclosed in the aforementioned Japanese Patent Publication No. H03-63386. These substances are commercially available.

Polyoxyethylene coconut fatty acid monoethanol amide phosphate ester salt [the above component (d)], one of organophosphorus compounds, acts to increase the viscosity of foams and create a viscous foam wall. The viscous foams are firmly hold water to provide significantly enhanced water-retentivity within foams, durability to heat of the foam fire-extinguishing agent, and liquid resistance allowing the foams to stay on a burning liquid surface over an extended time-period.

When the polyoxyethylene alkyl sulfate ester salt is used in combination with the lauric acid amide propyldimethyl amino betaine acetate or lauric acid amide propylhydroxy sulfobetaine, flame-resistant dodecyl alcohol ($C_{12}H_{26}O$) [the above component (e)], one of higher alcohols, can be added thereto to provide a performance more similar to the conventional fluorochemical surfactant, so as to foams to be created with significantly reduced time-based volume-reduction ratio and an enhanced heat resistance. The foams created on the oil surface have a higher viscosity and strength than that of foams obtained from the conventional fluorochemical surfactant.

The weight ratio of (1) polyoxyalkylenediamine having both terminal ends substituted with amino alkyl:(2) polyoxyethylene alkyl sulfate ester salt:(3) at least either one of lauric acid amide propyldimethyl amino betaine acetate and lauric acid amide propylhydroxy sulfobetaine:(4) dodecyl alcohol is preferably about (1) 4 to 6:(2) 20 to 25:(3) 10 to 15:(4) 0.5 to 1.5.

The weight ratio of (1) polyoxyethylene coconut fatty acid monoethanol amide phosphate ester salt:(2) polyoxyethylene alkyl sulfate ester salt:(3) at least either one of lauric acid amide propyldimethyl amino betaine acetate and lauric acid amide propylhydroxy sulfobetaine:(4) dodecyl alcohol is preferably about (1) 5 to 10:(2) 20 to 25:(3) 10 to 15:(4) 3 to 6.

Polyethyleneglycol may be added to the above components of the foam fire-extinguishing agent to provide enhanced heat-resistance and sealability of foams so as to create a strength foam film. Preferably, polyethyleneglycol 20000 or polyethyleneglycol 4000 may be used as the polyethyleneglycol.

The weight ratio of (1) polyoxyalkylenediamine having both terminal ends substituted with amino alkyl:(5) polyethyleneglycol is preferably about (1) 4 to 6:(2) 8 to 15.

The weight ratio of (1) polyoxyethylene coconut fatty acid monoethanol amide phosphate ester salt:(5) polyethyleneglycol is preferably about (1) 5 to 10:(5) 8 to 15.

Preferably, the above foam fire-extinguishing agent further includes polyoxyethylene alkylether triethanolamine. In this case, the weight ratio of (1) polyoxyalkylenediamine having both terminal ends substituted with amino alkyl:(3) at least either one of lauric acid amide propyldimethyl amino betaine acetate and lauric acid amide propylhydroxy sulfobetaine:(4) dodecyl alcohol:(6) polyoxyethylene alkylether triethanolamine is preferably about (1) 4 to 6:(3) 10 to 15:(4) 3 to 6:(6) 10 to 12.

The weight ratio of (1) polyoxyethylene coconut fatty acid monoethanol amide phosphate ester salt:(3) at least either one of lauric acid amide propyldimethyl amino betaine acetate and lauric acid amide propylhydroxy sulfobetaine:(4) dodecyl alcohol:(6) polyoxyethylene alkylether triethanolamine is preferably about (1) 5 to 10:(3) 10 to 15:(4) 3 to 6:(6) 10 to 12.

Preferably, the above foam fire-extinguishing agent further includes lauryl sulfate salt and nitrilotriacetic acid to bring out an adequate performance of the agent in not only freshwater-diluted form but also seawater-diluted form. The lauryl sulfate salt acts to provide enhanced foamability and water-retentivity. The nitrilotriacetic acid, one of chelate compounds, acts to soften hard water and provide enhanced foamability. The weight ratio of (1) polyoxyalkylenediamine having both terminal ends substituted with amino alkyl:(7) lauryl sulfate salt:(8) nitrilotriacetic acid is preferably about (1) 6 to 9:(7) 3 to 8:(8) 0.5 to 2.

The weight ratio of (1) polyoxyethylene coconut fatty acid monoethanol amide phosphate ester salt:(7) lauryl sulfate salt:(8) nitrilotriacetic acid is preferably about (1) 6 to 9:(7) 3 to 8:(8) 0.5 to 2.

In addition to the above components, the foam fire-extinguishing agent of the present invention may include a solvent, freezing-point depressant, liquid-resistance improver, foam stabilizer, rust inhibitor, pH regulator, hard-water resistant agent, oil resistant agent, heat resistant agent and/or foam stabilizer.

EXAMPLE

Example 1

The following mix components 1, 2 and 3 were mixed and stirred to prepare 4900 g of homogenous mixture composition.

Mix Component 1

500 g of water, 150 g of polyethyleneglycol 20000 and 500 g of polyoxyethylenediamine (Kawaken Fine Chemicals Co., Ltd.; PEO Amine 6000, average molecular mass=8000 to 8500, amine value=10~15, hydroxyl value≦2) were blended and mixed to prepare total 1150 g of mix component 1.

Mix Component 2

40 wt % of polyoxyethylene alkyl ammonium sulfate, 37 wt % of diethyleneglycolmonobutylether, 8 wt % of ethyleneglycol, 2 wt % of dodecyl alcohol and 13 wt % of water were blended and stirringly mixed to prepare total 3000 g of mix component 2.

Mix Component 3

600 g of lauric acid amide propyldimethyl amino betaine acetate and 150 g of dodecyl alcohol were mixed to prepare total 750 g of mix component 3.

Fire-Extinguishing Test 1

The above homogenous mixture composition was premixed with tap water at a dilution rate of 2 wt % to prepare a foam fire-extinguishing agent.

The following fire-extinguishing test was carried out to check the performance of the fire-extinguishing agent of the present invention when used in a high-expansion foam mode. 50 L of N-heptane (oil layer: 30 mm) serving as test fuel was fed in a rectangular iron oil tray (MSC CIRC, 670: 1.42 m(p) for fire extinguishing tests. The atmospheric temperature and water temperature were 22° C. and 20° C., respectively. The expansion ratio was 896:1. The expansion ratio was determined by encasing discharged foams in a vessel to measure its volume, and divided the measured volume by its initial volume before discharging.

After 60 seconds from the ignition of the test fuel, the above foam fire-extinguishing agent was discharged onto the flame surface using a testing high-expansion nozzle (MSC, CIRC, 670 High-Expansion Foam Generator) at a nozzle pressure of 5 atm and a discharge rate of 6.0 L/min. After 60 seconds from the ignition/preheating, the foam discharge was initiated. The flame could be rapidly controlled after 15 seconds from the initiation of the discharging. After 64 seconds, the surrounding walls of the tray were filled with the foams, and the flame was quenched. The foam fire-extinguishing agent of the present invention could control the flame at a significantly high speed which was far superior to the requirement of within 3 minutes for quenching-time prescribed in Japanese Fire Defense Law.

Fire-Extinguishing Test 2

The above homogenous mixture composition was premixed with tap water at a dilution rate of 3 wt % to prepare a foam fire-extinguishing agent.

The following fire-extinguishing test was carried out to check the performance of the fire-extinguishing agent of the present invention when used in a low-expansion foam mode. 130 L of N-heptane (oil layer: 20 mm) serving as test fuel was fed in a rectangular iron oil tray (MSC CIRC, 582: 2.12 m×2.12 m=4.5 $m^2$) for fire extinguishing tests. The atmospheric temperature and water temperature were 12° C. and 10° C., respectively. The expansion ratio was 11:1. The expansion ratio was determined by encasing discharged foams in a vessel to measure its volume, and divided the measured volume by its initial volume before discharging.

After 60 seconds from the ignition of the test fuel, the above foam fire-extinguishing agent was discharged onto the flame surface using a testing standard-expansion nozzle (MSC, CIRC, 582 STD) at a nozzle pressure of 4.5 kgf and a discharge rate of 2.5 L/min. The time between the ignition and the quenching was 120 seconds (the requirement of Japanese Fire Defense Law: within 5 minutes). After 300 seconds, the foam discharge was discontinued. After 600 seconds from the ignition, a re-fire test was initiated. The exposed oil-surface area after 15 minutes was about 0.5 $m^2$, and the exposed oil-surface area rate was 0.5 $m^2$/4.5 $m^2$=11.2% which was far superior to the requirement of less than 25% for exposed oil-surface area rate after 15 minutes prescribed in Japanese Fire Defense Law.

Drainage Test

The above homogenous mixture composition was premixed with synthetic seawater at a dilution rate of 3 wt % to prepare a foam fire-extinguishing agent.

The following drainage test prescribed in Japanese Fire Defense Law was carried out to check the water-retentivity within foams of the fire-extinguishing agent of the present invention. Under the same conditions as those in the above Fire-Extinguishing Test 2, foams having an expansion ratio of 11:1 were created. 25% drainage time was about 14 minutes. Japanese Fire Defense Law prescribes that in low-expansion foam fire-extinguishing agents (aqueous-film-forming foam fire-extinguishing agents), "the time for restoring 25% of foam solution volume before foaming, from foams shall be equal to or more than 1 minute", and in foam fire-extinguishing agents having a expansion ratio of 500:1 or more, it shall be equal to or more than 3 minutes. The above test result is far superior to the requirement of equal to or more than 1 minute for low-expansion foam fire-extinguishing agents prescribed in Japanese Fire Defense Law. Thus, the foam fire-extinguishing agent of the present invention evidently contains a large amount of water content in foams or excellent water-retentivity.

Example 2

The following mix components 1, 2, 3 and 4 were mixed and stirred to prepare 5140 g of homogenous mixture composition. Polyoxyethylene coconut fatty acid monoethanol amide phosphate ester salt was used as a substitute for polyoxyethylenediamine in EXAMPLE 1. Further, the mix component 4 was added.

Mix Component 1

500 g of water, 150 g of polyethyleneglycol 20000 and 400 g of polyoxyethylene coconut fatty acid monoethanol amide phosphate ester salt (Kawaken Fine Chemicals Co., Ltd.; Amizett P52) were blended and mixed to prepare total 1050 g of mix component 1.

Mix Component 2

40 wt % of polyoxyethylene alkyl ammonium sulfate, 37 wt % of diethyleneglycolmonobutylether, 8 wt % of ethyleneglycol, 2 wt % of dodecyl alcohol and 13 wt % of water were blended and stirringly mixed to prepare total 3000 g of mix component 2.

Mix Component 3

600 g of lauric acid amide propyldimethyl amino betaine acetate and 150 g of dodecyl alcohol were mixed to prepare total 750 g of mix component 3.

Mix Component 4

The mix composition 4 was prepared from 260 g of sodium lauryl sulfate and 80 g of nitrilotriacetic acid.

Fire-Extinguishing Test 1

The above homogenous mixture composition was premixed with synthetic seawater at a dilution rate of 3 wt % to prepare a foam fire-extinguishing agent, and then the foam fire-extinguishing agent was used within 10 minutes.

The following fire-extinguishing test was carried out to check the performance of the fire-extinguishing agent of the present invention when diluted with synthetic seawater. 50 L of N-heptane serving as test fuel was fed in a rectangular (4.5 $m^2$) iron oil tray (MSC CIRC, 682: standard nozzle) for fire extinguishing tests. The atmospheric temperature and water temperature were 15° C. and 15° C., respectively. The expansion ratio was 10.2:1. The expansion ratio was determined by encasing discharged foams in a vessel to measure its volume, and divided the measured volume by its initial volume before discharging.

After 60 seconds from the ignition of the test fuel, the above foam fire-extinguishing agent was discharged onto the flame surface using a testing high-expansion nozzle (MSC, CIRC, 582 STD High-Expansion Foam Generator) at a nozzle pressure of 6.3 atm and a discharge rate of 11.3 L/min. After 60 seconds from the ignition/preheating, the foam discharge was initiated. After 2 minutes and 50 seconds, the flame was quenched. After 6 minutes, the foam discharge was discontinued. The thickness of the resulting foam blanket was 150 mm.

After 11 minutes, a re-fire test was initiated. Even after 5 minutes, the foams were stably maintained without foaming away around re-ignition pots. After 10 minutes, a small area of the oil surface was exposed by one pot. After 15 minutes, the exposed oil surface area becomes 25%, and the oil face caught fire. The re-fire test was cleared, and the re-fire test result was far superior to the requirement of within 25% oil surface exposure after 5-minute burning prescribed in Japanese Fire Defense Law.

Drainage Test

Under the same conditions as those in the above Fire-Extinguishing Test 1, foams having an expansion ratio of 10.2:1 were created. 25% drainage time was about 14 minutes. Even in the seawater-diluted form, the foam fire-extinguishing agent of the present invention had the above test result far superior to the requirement of equal to or more than 1 minute for low-expansion foam fire-extinguishing agents prescribed in Japanese Fire Defense Law, and evidently contains a large amount of water content in foams or excellent water-retentivity.

Comparative Example 1

In the foam fire-extinguishing agent in EXAMPLE 2, the polyoxyethylene coconut fatty acid monoethanol amide phosphate ester salt was removed from the mix component 1, and the component 4 of lauryl sulfate salt and nitrilotriacetic acid was removed. A fire-extinguishing test was carried out under the same conditions as those in EXAMPLE 2. The expansion ratio was 9:1.

After 60 seconds from the ignition/preheating, the foam discharge was initiated. After 5 minutes and 30 seconds, the flame was quenched. After 300 seconds, the foam discharge was discontinued. After 6 minutes, the foam discharge was discontinued. If the flame cannot be quenched within about 3 minutes, it is difficult to assure a sufficient foam thickness for the re-fire test. The thickness of the resulting foam blanket was only 30 to 50 mm incapacitated to the re-fire test, and thus the test was discontinued.

Example 3

The following mix components 1, 2, 3 and 4 were mixed and stirred to prepare 5240 g of homogenous mixture composition. The amount of polyoxyethylene coconut fatty acid monoethanol amide phosphate ester salt was increased as compared to that in EXAMPLE 2, and lauric acid amide propylhydroxy sulfobetaine was used as a substitute for lauric acid amide propyldimethyl amino betaine acetate.

Mix Component 1

500 g of water, 150 g of polyethyleneglycol 20000 and 500 g of polyoxyethylene coconut fatty acid monoethanol amide phosphate ester salt (Kawaken Fine Chemicals Co., Ltd.; Amizett P52) were blended and mixed to prepare total 1150 g of mix component 1.

Mix Component 2

40 wt % of polyoxyethylene alkyl ammonium sulfate, 37 wt % of diethyleneglycolmonobutylether, 8 wt % of ethyleneglycol, 2 wt % of dodecyl alcohol and 13 wt % of water were blended and stirringly mixed to prepare total 3000 g of mix component 2.

Mix Component 3

600 g of lauric acid amide propylhydroxy sulfobetaine and 150 g of dodecyl alcohol were mixed to prepare total 750 g of mix component 3.

Mix Component 4

The mix composition 4 was prepared from 260 g of lauryl sulfate of soda and 80 g of nitrilotriacetic acid.

Fire-Extinguishing Test 1

The above homogenous mixture composition was premixed with synthetic seawater at a dilution rate of 3 wt % to prepare a foam fire-extinguishing agent, and then the foam fire-extinguishing agent was used within 10 minutes.

The following fire-extinguishing test was carried out under the same conditions as those in EXAMPLE 2. The expansion ratio was 10.2:1. After 2 minutes and 40 seconds from the ignition of test fuel, the flame was quenched. After 6 minutes, the foam discharge was discontinued. The thickness of the resulting foam blanket was 150 mm.

After 11 minutes, a re-fire test was initiated. The test fuel was neither re-ignited nor fired due to a string foam sealing. The re-fire test was cleared, and a better re-fire test result could be obtained than that in EXAMPLE 2.

Drainage Test

Under the same conditions as those in the above Fire-Extinguishing Test 1, foams having an expansion ratio of 10.2:1 were created. 25% drainage time was about 14 minutes.

INDUSTRIAL APPLICABILITY

The synthetic-surfactant-based foam fire-extinguishing agent of the present invention is substitutable for the conventional high-performance aqueous-film-forming foam fire-extinguishing agent using fluorochemical surfactant. The synthetic-surfactant-based foam fire-extinguishing agent devoid of fluorochemical surfactant, such as perfluorooctanyl compounds, which has problems in terms of ecology and cost performance exhibits excellent fire-extinguishing performance, resistance to flame, durability to heat, liquid resistance and re-ignition preventing performance superior to the conventional foam fire-extinguishing agent using fluorochemical surfactant. The foam fire-extinguishing agent of the present invention is innovative in that it is usable as both high- and low-expansion foam fire-extinguishing agents and in both seawater-diluted and freshwater-diluted forms while maintaining adequate performances, cost performance, and environmental safety in terms of decomposition products.

What is claimed is:

1. A foam fire-extinguishing agent for use as a high-expansion or low-expansion foam fire-extinguishing agent, said foam fire-extinguishing agent comprising a foamable synthetic surfactant consisting of:

polyoxyethylene alkyl sulfate ester salt; and at least either one of lauric acid arnide propyldimethyl amino betaine acetate and lauric acid amide propyihydroxy sulfobetaine, wherein said foam fire-extinguishing agent is devoid of fluorochemical surfactant.

2. The foam fire-extinguishing agent as defined in claim 1, which includes polyoxyalkylenediamine having both terminal ends substituted with amino alkyl, and derivatives thereof.

3. The foam fire-extinguishing agent as defined in claim 1 or 2, which includes polyoxyethylene coconut fatty acid monoethanol amide phosphate ester salt.

4. The foam fire-extinguishing agent as defined in claim 1 or 2, which includes dodecyl alcohol.

5. The foam fire-extinguishing agent as defined in claim 1 or 2 which includes polyethyleneglycol.

6. The foam fire-extinguishing agent as defined in claim 1 or 2, which includes lauryl sulfate salt.

7. The foam fire-extinguishing agent as defined in claim 1 or 2 which includes nitrilotriacetic acid.

* * * * *